US008613664B2

(12) United States Patent
Anderson et al.

(10) Patent No.: US 8,613,664 B2
(45) Date of Patent: Dec. 24, 2013

(54) WAGERING INTERFACE FOR A GAMING SYSTEM

(75) Inventors: Peter R. Anderson, Glenview, IL (US); Dion K. Aoki, Henderson, NV (US); Andrew Guinn, Chicago, IL (US); Darren Ng, Chicago, IL (US); Richard B. Robbins, Glenview, IL (US); Richard T. Schwartz, Chicago, IL (US); Tracey Wright, West Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 593 days.

(21) Appl. No.: 12/917,676

(22) Filed: Nov. 2, 2010

(65) Prior Publication Data

US 2011/0117999 A1 May 19, 2011

Related U.S. Application Data

(60) Provisional application No. 61/260,928, filed on Nov. 13, 2009.

(51) Int. Cl.
*A63F 9/24* (2006.01)
*A63F 13/00* (2006.01)

(52) U.S. Cl.
USPC ..... 463/31; 463/16; 463/25; 463/29; 463/30; 273/138.1; 273/138.2; 273/143 R

(58) Field of Classification Search
USPC ..... 463/16, 25, 29, 30–31; 273/138.1, 273/138.2, 143 R
See application file for complete search history.

(56) References Cited

U.S. PATENT DOCUMENTS 3,638,944 A 2/1972 McQueen
4,624,459 A 11/1986 Kaufman
4,669,731 A 6/1987 Clarke (Continued)

FOREIGN PATENT DOCUMENTS

WO WO 85/00910 2/1985
WO WO 2007/089410 A2 8/2007

OTHER PUBLICATIONS

PartyPoker, No Limit Poker tutorial, 2002, from http://web.archive.org/web/20021201161939/http://www.partypoker.com/games/how_to_play/no_limit.html, (viewed on Jul. 12, 2009), , 2 pages.

(Continued)

*Primary Examiner* — William Brewster
*Assistant Examiner* — Ryan Hsu
(74) *Attorney, Agent, or Firm* — Nixon Peabody LLP

(57) ABSTRACT

A gaming system includes a wagering interface that may include a plurality of player-selectable quick-bet elements with each quick-bet element indicating a different total wager for a spin of the plurality of reels. Each total wager is divided among a plurality of paylines associated with positions on the reels. A window is configured to display a subset of the plurality of quick-bet elements. A quick-bet element selection slider is configured to allow each of the plurality of player-selectable quick-bet elements to be displayed within the window. The selection slider is movable to a plurality of positions along a slider path such that the position of the selection slider on the slider path determines the subset of quick-bet elements to be displayed in the window. A wagering interface may include a toggling element for switching from a wagering interface having a plurality of player-selectable quick-bet elements to a classic-bet wagering interface.

20 Claims, 12 Drawing Sheets

(56) References Cited

U.S. PATENT DOCUMENTS

| | | | |
|---|---|---|---|
| 4,695,053 | A | 9/1987 | Vazquez, Jr. et al. |
| 4,991,848 | A | 2/1991 | Greenwood et al. |
| 5,116,055 | A | 5/1992 | Tracy |
| 5,277,424 | A | 1/1994 | Wilms |
| 5,342,047 | A | 8/1994 | Heidel et al. |
| 5,344,144 | A | 9/1994 | Canon |
| 5,397,125 | A | 3/1995 | Adams |
| 5,437,451 | A | 8/1995 | Fulton |
| 5,511,781 | A | 4/1996 | Wood et al. |
| 5,611,535 | A | 3/1997 | Tiberio |
| 5,645,485 | A | 7/1997 | Clapper, Jr. |
| 5,743,799 | A | 4/1998 | Houriet et al. |
| 5,769,716 | A | 6/1998 | Saffari et al. |
| 5,779,549 | A | 7/1998 | Walker et al. |
| 5,803,809 | A | 9/1998 | Yoseloff |
| 5,817,172 | A | 10/1998 | Yamada et al. |
| 5,823,874 | A | 10/1998 | Adams |
| 5,848,932 | A | 12/1998 | Adams |
| 5,885,158 | A | 3/1999 | Torango et al. |
| 5,910,048 | A | 6/1999 | Feinberg |
| 5,967,893 | A | 10/1999 | Lawrence et al. |
| 5,993,316 | A | 11/1999 | Coyle et al. |
| 6,004,207 | A | 12/1999 | Wilson, Jr. et al. |
| 6,012,983 | A | 1/2000 | Walker et al. |
| 6,062,980 | A | 5/2000 | Luciano |
| 6,093,100 | A | 7/2000 | Singer et al. |
| 6,102,400 | A | 8/2000 | Scott et al. |
| 6,110,041 | A | 8/2000 | Walker et al. |
| 6,113,098 | A | 9/2000 | Adams |
| 6,126,542 | A | 10/2000 | Fier |
| 6,155,925 | A | 12/2000 | Giobbi et al. |
| 6,158,741 | A | 12/2000 | Koelling |
| 6,159,095 | A | 12/2000 | Frohm et al. |
| 6,159,097 | A | 12/2000 | Gura |
| 6,159,098 | A | 12/2000 | Slomiany et al. |
| 6,168,522 | B1 | 1/2001 | Walker et al. |
| 6,168,523 | B1 | 1/2001 | Piechowiak et al. |
| 6,174,233 | B1 | 1/2001 | Sunaga et al. |
| 6,174,235 | B1 | 1/2001 | Walker et al. |
| 6,186,894 | B1 | 2/2001 | Mayeroff |
| 6,203,429 | B1 | 3/2001 | Demar et al. |
| 6,210,277 | B1 | 4/2001 | Stefan |
| 6,213,877 | B1 | 4/2001 | Walker et al. |
| 6,224,482 | B1 | 5/2001 | Bennett |
| 6,224,483 | B1 | 5/2001 | Mayeroff |
| 6,227,969 | B1 | 5/2001 | Yoseloff |
| 6,227,971 | B1 | 5/2001 | Weiss |
| 6,231,442 | B1 | 5/2001 | Mayeroff |
| 6,231,445 | B1 | 5/2001 | Acres |
| 6,234,897 | B1 | 5/2001 | Frohm et al. |
| 6,238,287 | B1 | 5/2001 | Komori et al. |
| 6,241,607 | B1 | 6/2001 | Payne et al. |
| 6,244,957 | B1 | 6/2001 | Walker et al. |
| 6,254,482 | B1 | 7/2001 | Walker et al. |
| 6,270,409 | B1 | 8/2001 | Shuster |
| 6,280,328 | B1 | 8/2001 | Holch et al. |
| 6,299,165 | B1 | 10/2001 | Nagano |
| 6,302,791 | B1 | 10/2001 | Frohm et al. |
| 6,309,299 | B1 | 10/2001 | Weiss |
| 6,312,331 | B1 | 11/2001 | Tamaki |
| 6,315,662 | B1 | 11/2001 | Jorasch et al. |
| 6,336,862 | B1 | 1/2002 | Byrme |
| 6,506,116 | B1 | 1/2003 | Sunaga et al. |
| 6,517,433 | B2 | 2/2003 | Loose et al. |
| 7,699,699 | B2 * | 4/2010 | Gilliland et al. ..... 463/20 |
| 8,313,382 | B2 * | 11/2012 | Ward ..... 463/42 |
| 2001/0041610 | A1 | 11/2001 | Luciano et al. |
| 2002/0065127 | A1 | 5/2002 | Kamimura et al. |
| 2002/0077171 | A1 | 6/2002 | Ainsworth |
| 2003/0045354 | A1 | 3/2003 | Giobbi |
| 2003/0069068 | A1 | 4/2003 | Kaminkow |
| 2006/0068498 | A1 | 3/2006 | White et al. |
| 2006/0279044 | A1 | 12/2006 | Pacey |
| 2007/0184891 | A1 | 8/2007 | Thomas |
| 2010/0016075 | A1 | 1/2010 | Thomas |
| 2010/0056256 | A1 * | 3/2010 | Surmacz et al. ..... 463/20 |

OTHER PUBLICATIONS

Screen shot from *Liong: The Dragon Dance*, from www.netflix.com (viewed on or before Mar. 19, 2009), 1 page.

Screen shots of on-line wagering interfaces by Cryptologic Intercasino, Partycasino, PKR, 888, 32 Red, and Skyvegas Wagerworks (viewed on or before Mar. 19, 2009), 1 page.

* cited by examiner

WAGERING INTERFACE FOR A GAMING SYSTEM

CROSS-REFERENCE To RELATED APPLICATION

This application is related to and claims the benefit of U.S. Provisional Application No. 61/260,928, filed Nov. 13, 2009, which is hereby incorporated by reference herein in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to a gaming system having a wagering interface with a plurality of player-selectable wagering elements.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Classic wagering interfaces typically include a total bet based on one or more paylines for each spin of the reels in a slot machine. A user typically has to select the number of paylines for a particular spin and the bet per payline, for which the gaming terminal typically displays a total bet for a particular reel spin.

SUMMARY OF THE INVENTION

According to one aspect of the present invention, a gaming system for conducting a slots game has a controller operative to present a wagering interface on a display. The wagering interface is associated with a wagering game having a plurality of symbol-bearing reels. The wagering interface includes a plurality of player-selectable quick-bet elements with each quick-bet element indicating a different total wager for a spin of the plurality of reels. Each total wager is at least partially divided among a plurality of paylines associated with positions on one or more of the reels. A window is configured to display a subset of the plurality of quick-bet elements. A quick-bet element selection slider is configured to allow each of the plurality of player-selectable quick-bet elements to be displayed within the window. The selection slider is movable to a plurality of positions along a slider path such that the position of the selection slider on the slider path determines the subset of quick-bet elements to be displayed in the window.

According to another aspect of the invention, a method for conducting wagering on a slots game having a plurality of symbol-bearing reels that is implemented on one or more processors associated with a gaming system includes receiving a wager via a network connection associated with the one or more processors. The wager is associated with a wagering interface that includes a plurality of player-selectable quick-bet elements with each quick-bet element configured to indicate a different total wager for a spin of the plurality of reels and each total wager being at least partially divided among a plurality of paylines. The wager interface also includes a window with at least a portion of the quick-bet elements being initially displayed in the window and at least a portion of the quick-bet elements not being initially displayed in the window. A quick-bet selection slider is movable to a plurality of positions along a slider path such that the position of the selection slider on the slider path determines the portion of the quick-bet elements to be displayed in the window. The method further includes receiving an input via a network connection associated with the one or more processors. The input is associated with a position of the selection slider along the slider path of the wagering interface. In response to the received input, the portion of quick-bet elements to be displayed in the window is reconfigured.

According to yet another aspect of the invention, one or more computer readable storage media are encoded with instructions, which when executed by at least one processor associated with a gaming system, causes the at least one processor to perform the above methods.

According to another aspect of the invention, a gaming system has a controller operative to present a plurality of wagering interfaces on a display. The plurality of wagering interfaces are associated with a wagering game having a plurality of symbol-bearing reels. The plurality of wagering interfaces include a first wagering interface associated with a display and a second wagering interface associated with the display. At least one quick-toggle element is located on each of the first and second wagering interfaces and configured for switching between the first wagering interface and the second wagering interface by user selection of the at least one quick-toggle element.

Additional aspects of the invention will be apparent to those of ordinary skill in the art in view of the detailed description of various embodiments, which is made with reference to the drawings, a brief description of which is provided below.

Figure 1A:
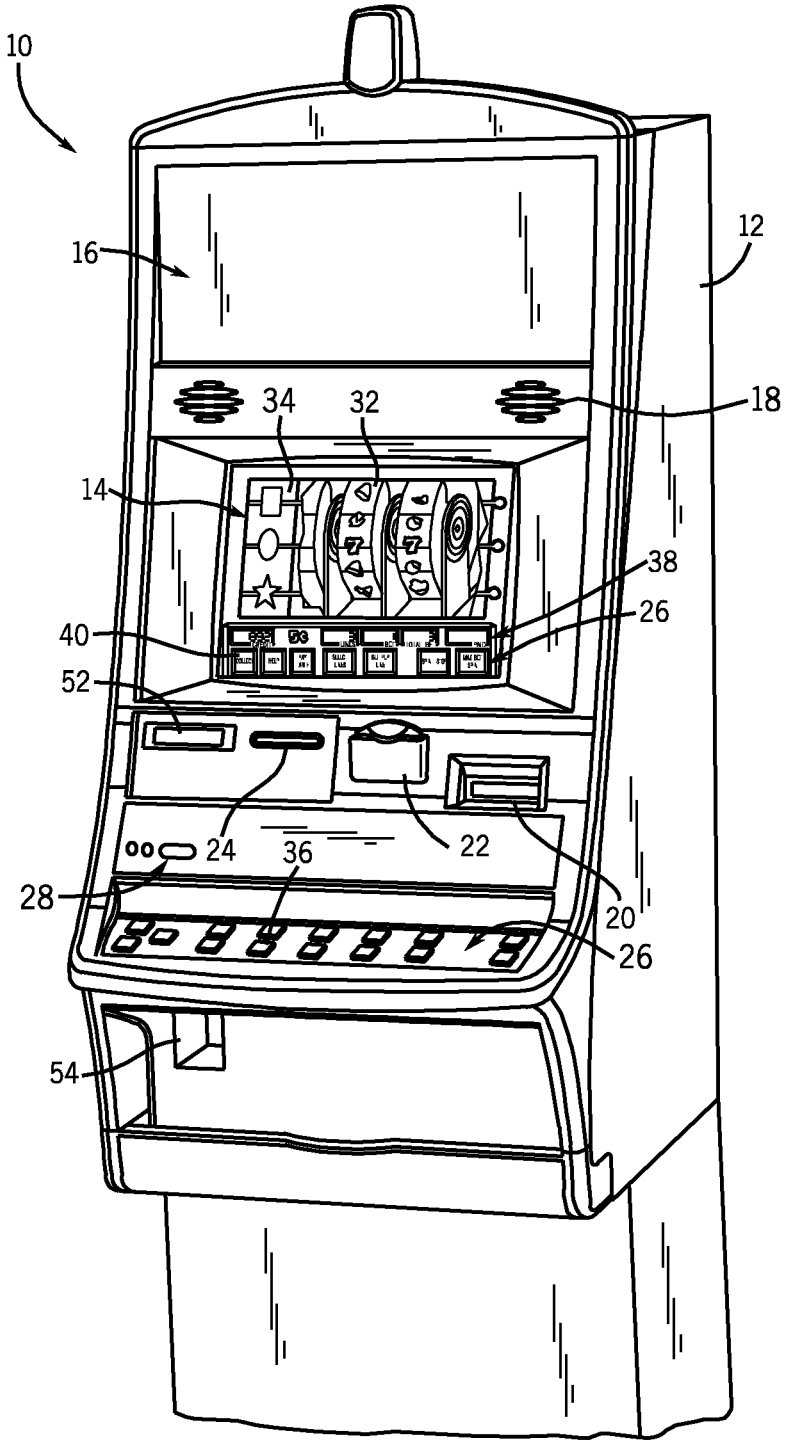
Fig. 1a PRIOR ART
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
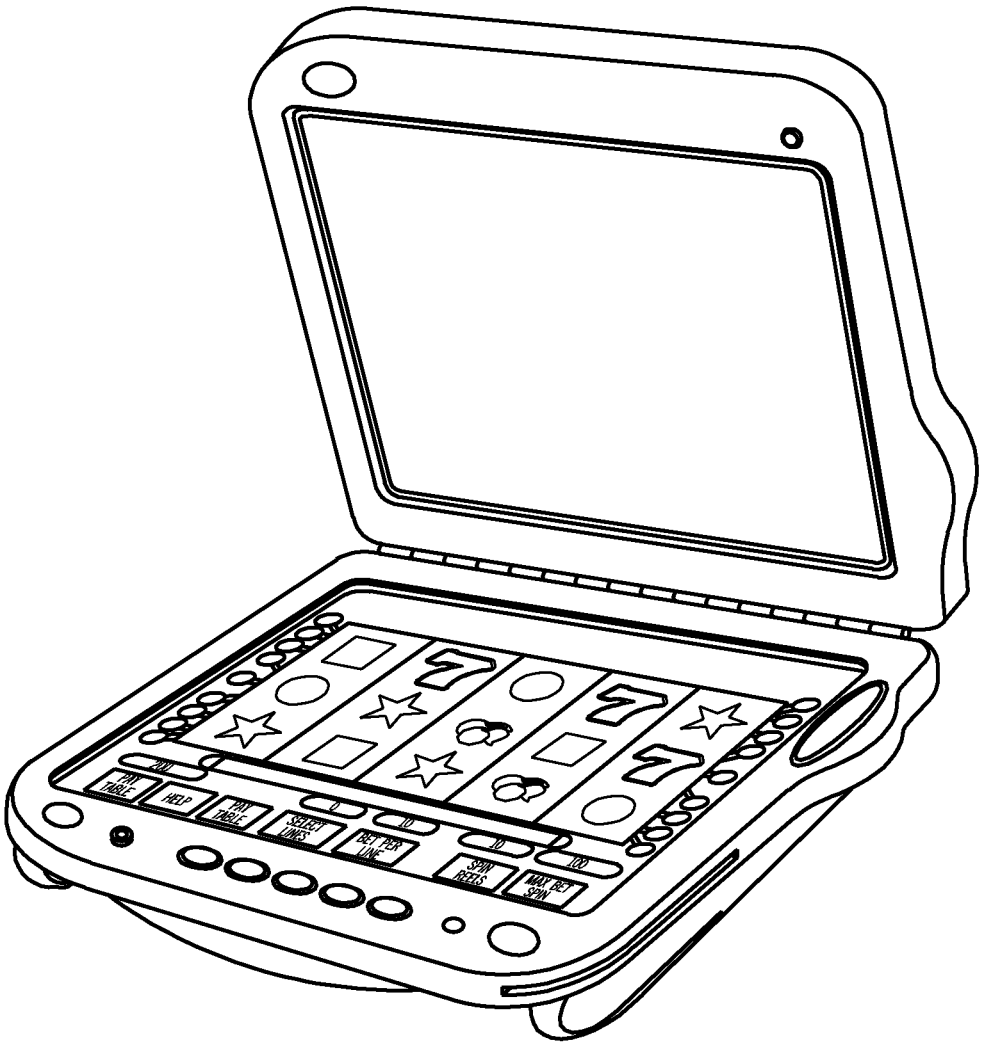
Fig. 1b PRIOR ART
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
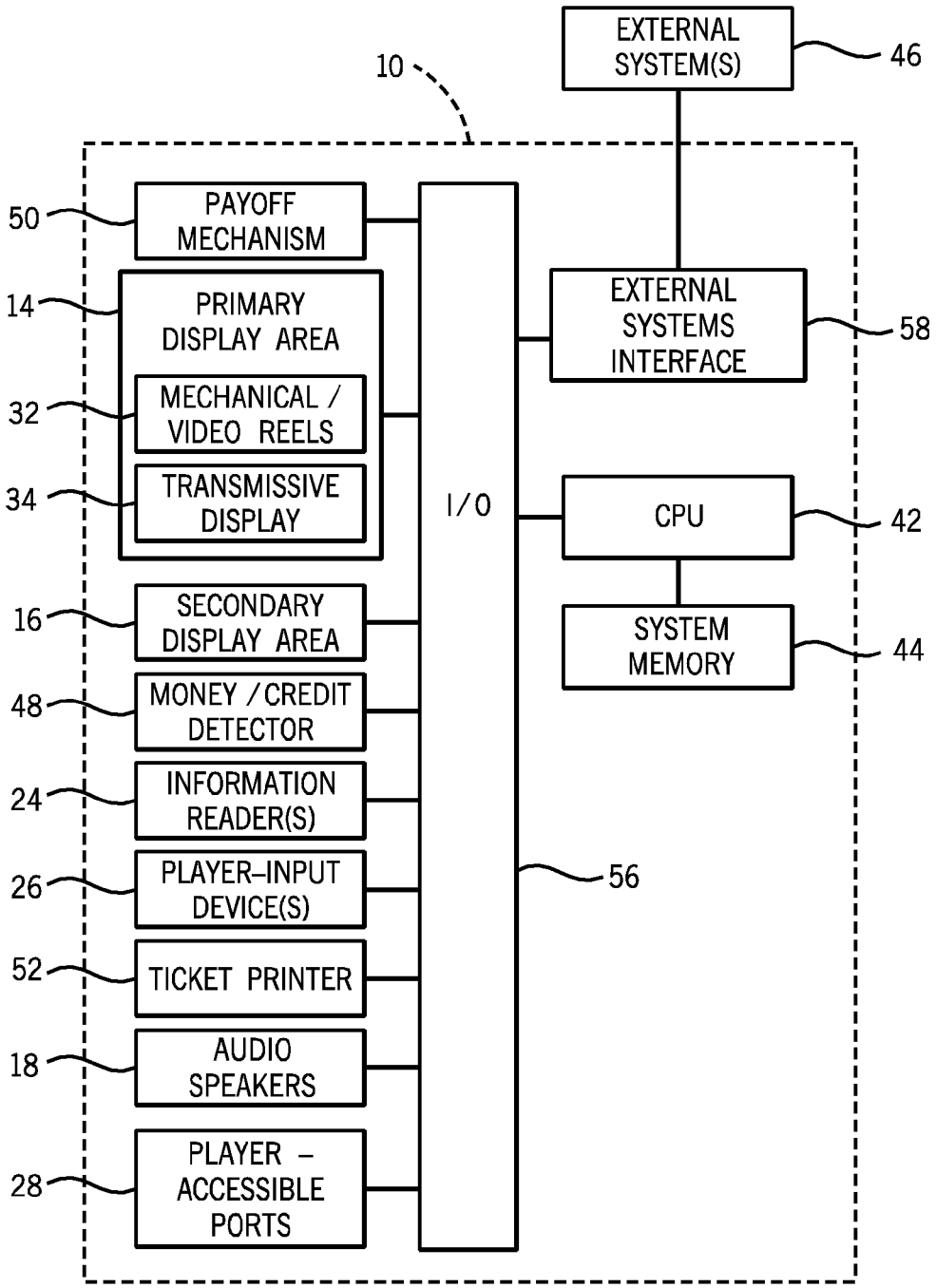
Fig. 2 PRIOR ART
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game (s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10 bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

It is contemplated that in certain embodiments, the gaming terminal 10 may be a personal computer or dummy-terminal type of device having a display and user interface that allows a player to play an online wagering game via the Internet. A processor or multiple processors located on one or more systems may control the game and control communications transmitted to and received by the personal computer or dummy-terminal device. A player may also provide inputs via an input device such as a mouse, keyboard, touchscreen, or otherwise, with the inputs being transmitted to and received by the processor(s). It is also contemplated that certain operations may be performed on a processor associated within the personal computer or dummy-terminal type of device and other operations may be performed elsewhere by a processor associated with other gaming assets.

Figure 3:
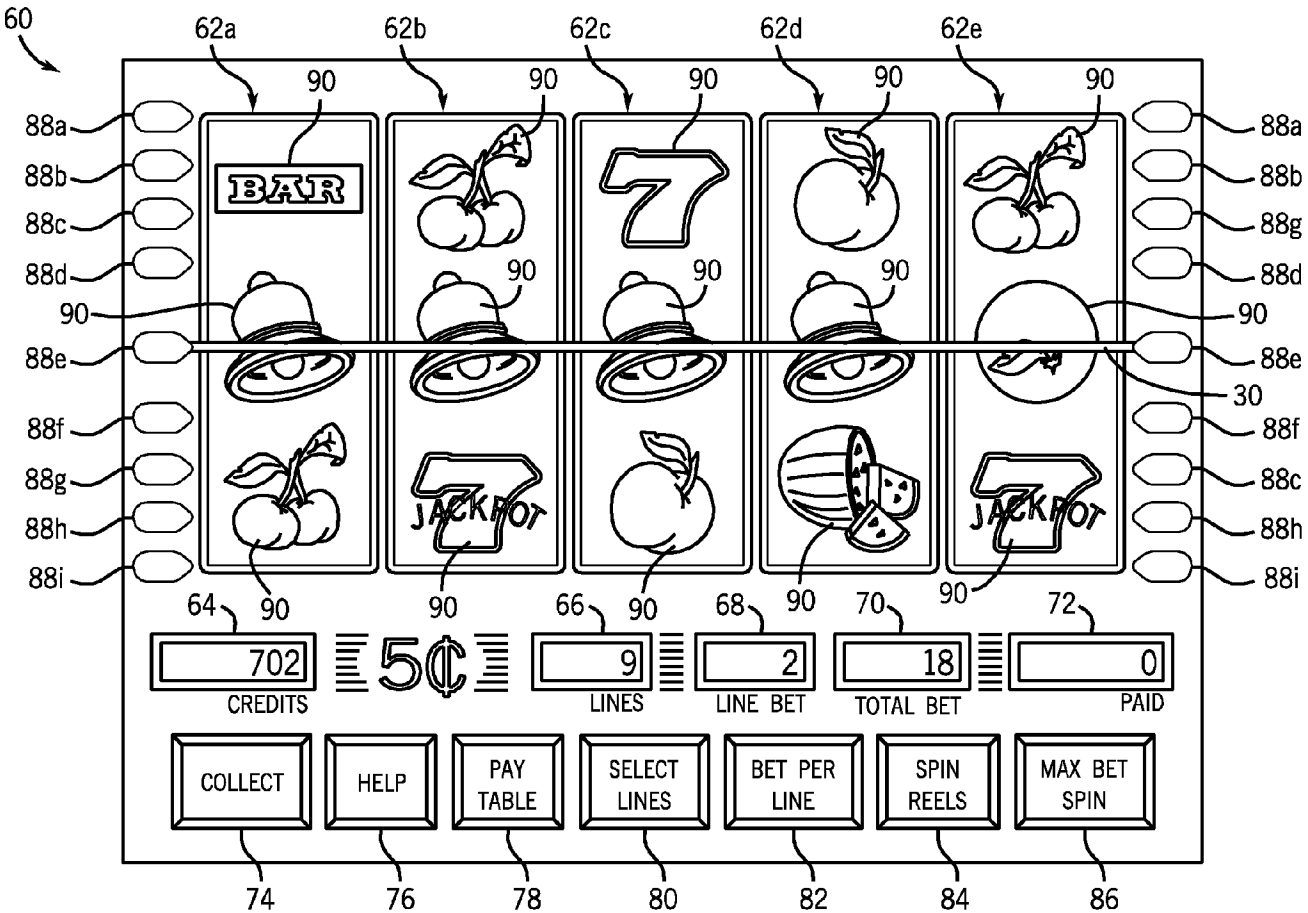
Fig. 3 PRIOR ART
FIG. 3 is an image of a basic-game screen of a wagering game that may be displayed on a gaming terminal, according to an embodiment of the present invention.

Referring now to FIG. 3, an image of a basic-game screen 60 adapted to be displayed on the primary display area 14 is illustrated, according to one embodiment of the present invention. A player begins play of a basic wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The basic-game screen 60 may be displayed on the primary display area 14 or a portion thereof. In FIG. 3, the basic-game screen 60 portrays a plurality of simulated movable reels 62*a-e*. Alternatively or additionally, the basic-game screen 60 may portray a plurality of mechanical reels. The basic-game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the basic-game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
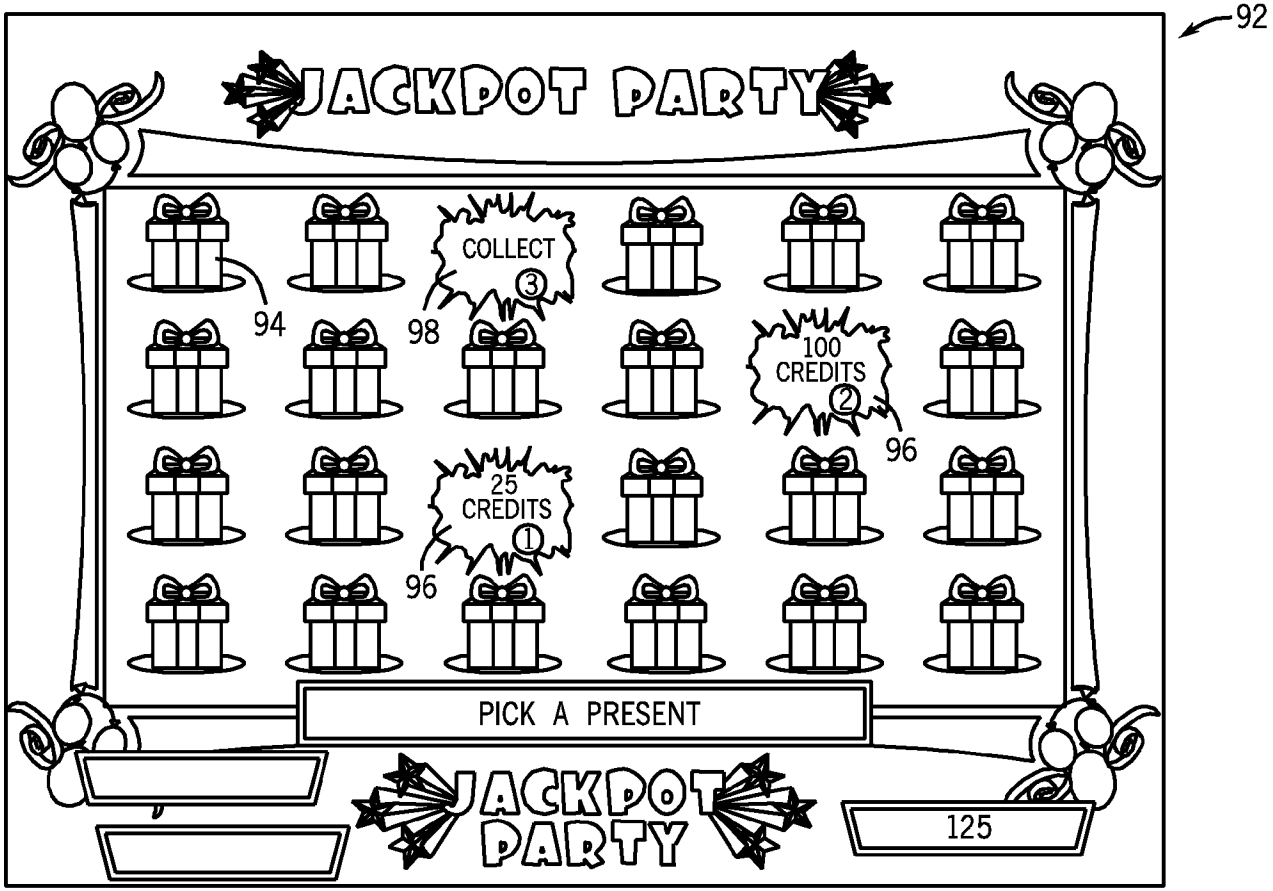
Fig. 4 PRIOR ART
FIG. 4 is an image of a bonus-game screen of a wagering game that may be displayed on a gaming terminal, according to an embodiment of the present invention.

Turning now to FIG. 4, a bonus game that may be included with a basic wagering game is illustrated, according to one embodiment. A bonus-game screen 92 includes an array of markers 94 located in a plurality of columns and rows. The bonus game may be entered upon the occurrence of a special start-bonus game outcome (e.g., symbol trigger, mystery trigger, time-based trigger, etc.) in or during the basic wagering game. Alternatively, the illustrated game may be a stand-alone wagering game.

In the illustrated bonus game, a player selects, one at a time, from the array of markers 94 to reveal an associated bonus-game outcome. According to one embodiment, each marker 94 in the array is associated with an award outcome 96 (e.g., credits or other non-negative outcomes) or an end-game outcome 98. In the illustrated example, a player has selected an award outcome 96 with the player's first two selections (25 credits and 100 credits, respectively). When one or more end-game outcome 98 is selected (as illustrated by the player's third pick), the bonus game is terminated and the accumulated award outcomes 96 are provided to the player.

Ease-of-use and customer adaptability contribute to the entertainment value and attraction of the slot machines. By developing a gaming machine that adapts to a particular user's wagering style or game-play desires, a user may be persuaded to select such a gaming machine over the competing machines. The user may also remain on a gaming machine longer when the gaming machine meets these needs. As such, a new gaming machine and method are required to meet one or more of these needs.

Figure 5:
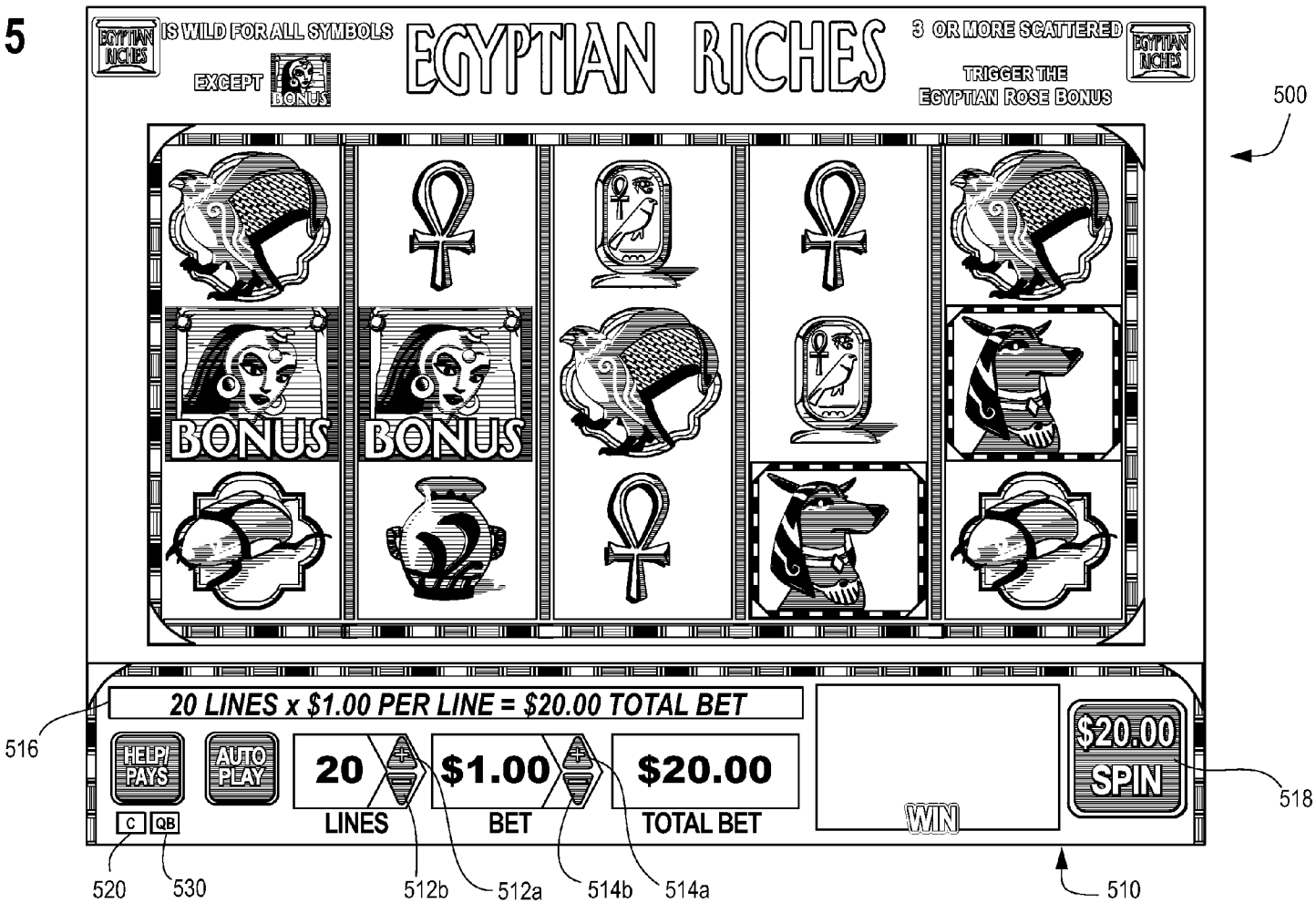
FIG. 5 is an image of a game screen with a player-selectable wagering interface for a wagering game that may be displayed on a gaming terminal, according to an embodiment of the present invention.

Referring now to FIG. 5, another exemplary embodiment of a base wagering game is illustrated such as an EGYPTIAN RICHES™ themed wagering game. FIG. 5 includes an image of a game screen 500 with a wagering interface 510 for a wagering game that can be used for a gaming session. The exemplary base wagering game is a slots game having five reels, though more or fewer reels are contemplated. Each reel includes a plurality of symbols displayed to a player along with a plurality of symbols that are invisible or not displayed to the player. The wagering game may be displayed on a display or in a display area, as illustrated and discussed, for example, in FIGS. 1*a*, 1*b*, and 2. It is further contemplated that the wagering game may be displayed as an image on a screen 500 associated with a remote gaming device or otherwise. The embodiment illustrated on screen 500 includes a classic wagering interface 510 located at the bottom of the screen 500. The wagering interface 510 may be displayed elsewhere on the screen including the top or sides of the screen, or on a separate display device altogether, such as a secondary display or a button display.

The exemplary classic wagering interface 510 of FIG. 5 allows a player to adjust with the up arrow (e.g., plus sign) 512*a* and down arrow (e.g., minus sign) 512*b* the number of paylines the player is wagering on for each play or spin of the reels. The illustrated wagering interface allows a player to select up to twenty paylines though more or fewer are contemplated. A player can similarly adjust how much they want to bet per payline. The betting up arrow (e.g., plus sign) 514*a* and the betting down arrow (e.g., minus sign) 514*b* allow the player to adjust the amount they want to wager per payline. Selection of paylines and wagering amounts can also be adjusted using other contemplated devices such as a dial or a slider. If the player holds on any one of elements 512*a*, 512*b*, 514*a*, 514*b* the increase or decrease of the number of paylines or wager per line can increase or decrease at a faster rate. In certain embodiments, a player may provide inputs using a pointer or mouse device. The wager per payline may, for example, range from $0.01 to $2.00. In other embodiments, the range may be larger (e.g., up to $5.00 per payline, up to $10.00 per payline).

A wagering interface will typically have a maximum wager for each payline or an overall maximum total wager amount for each play or spin of the reels. In the embodiment illustrated in FIG. 5, the player has selected the maximum number of twenty paylines at a wager per payline of $1.00 for a total wager of $20.00. Wager equation 516 illustrates an example of how the total wager is determined. As the player adjusts the number of paylines and the wager amount, the wager equation 516 will constantly adjust along with the "LINES", "BET", and "TOTAL BET" boxes to reflect the latest selected number of paylines, wager per payline, and total wager, respectively. The total wager amount may also be displayed on a spin button 518 that may also include the total wager amount (e.g., $20.00). Upon pressing or selecting the spin button 518, the slot reels will proceed to spin at the total wager amount displayed on the button 518, followed by a subsequent game outcome.

It is contemplated that it may be desirable for a player to choose different wagering interfaces to enhance their gaming experience. For example, it can enhance a player gaming experience to be able to toggle (e.g., quick toggle) between multiple wagering interface by pressing or selecting a button or icon on the gaming device or the screen 500. To further illustrate this embodiment, FIG. 5 includes a first toggle icon 520 associated with the selection of a classic wagering interface and a second toggle icon 530 associated with a quick-bet wagering interface 710 (see FIG. 7). So within the same gaming or wager selection session, a player may switch between the different wagering interfaces by selecting the first toggle icon 520 or the second toggle icon 530. It is contemplated that icons 520, 530 can also be push buttons or similar input devices associated with gaming devices or that they can be selected via a touch screen or the use of a mouse-type pointer. The previously selected wager amount may persist as the player toggles between the different wagering interfaces. As illustrated between the examples of FIGS. 5 and 7, the total wager amount persists at $20.00 as the player toggles between the classic and the quick-bet wagering interfaces. Wager equation 516 and wager equation 716 both show a $20.00 total bet and spin button 518 and spin button 718 each display a $20.00 total wager for a spin.

Figure 6:
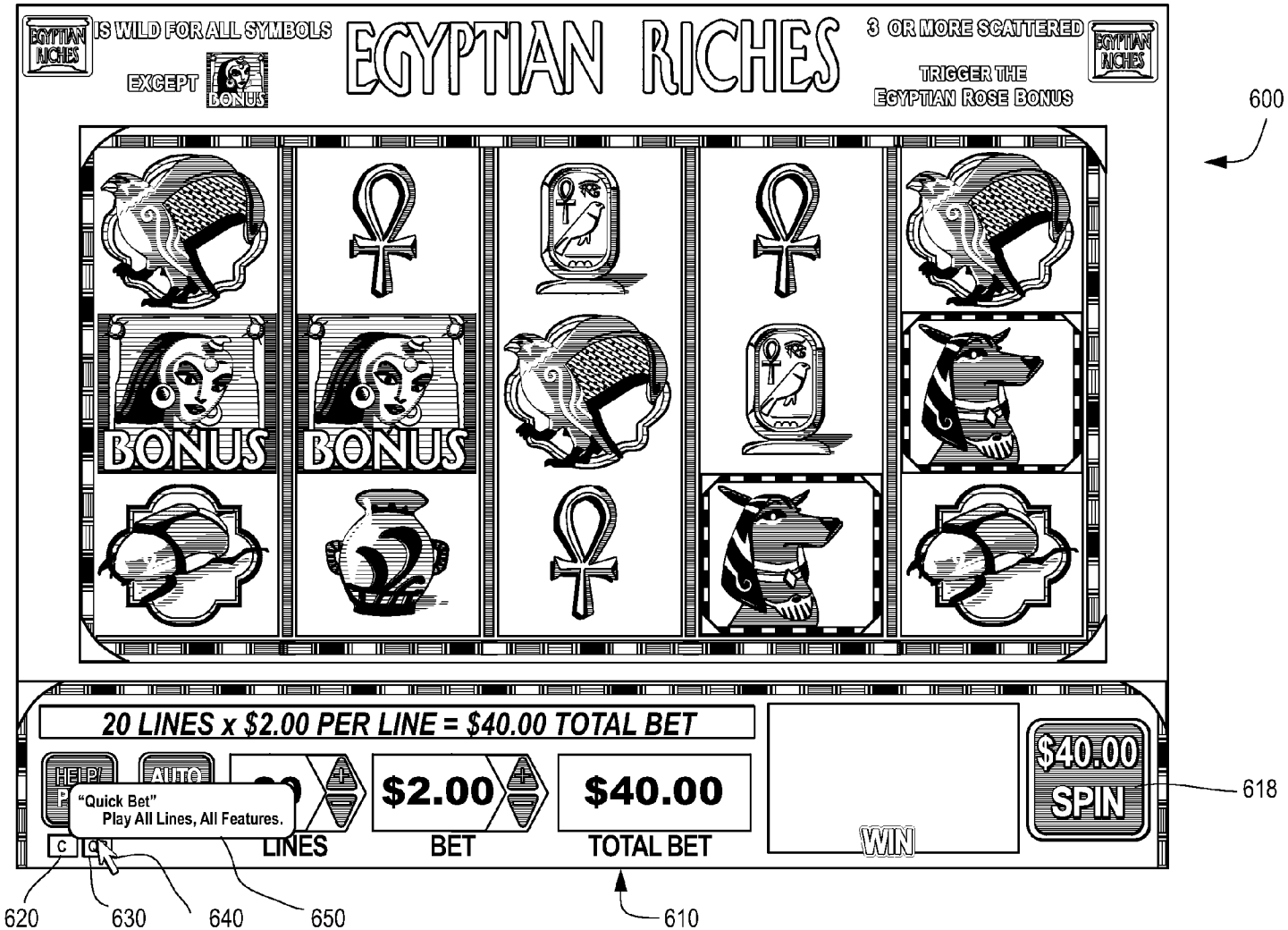
FIG. 6 is an image of a game screen with the player-selectable wagering interface of in FIG. 5 further illustrating selection of an alternate wagering interface, according to an embodiment of the present invention.

Turning now to FIG. 6, a different embodiment of a screen is illustrated. In FIG. 6, screen 600 includes a modified classic wagering interface 610 where the player has selected twenty paylines at a wager of $2.00 per payline with a total wager of $40.00. The spin button 618 displays the total wager amount to the player so that it is clear to the player the total amount that they are wagering prior to causing the reels to spin. FIG. 6 includes a first toggle button 620 and second toggle button 630. Further illustrated are a pointer element 640, such as a mouse pointer, which may be experienced by a player engaging in gaming activities over the Internet or on a personal computing device. As the player places or hovers the pointer element 640 over, for example, the second toggle icon (e.g., quick-bet toggle icon) 630, a pop-up message 650 is displayed that identifies the operation of icon 630 as implementing a "Quick Bet" wagering interface in which a player's wager will be distributed along all paylines and will also include all special side-wager features (e.g., bonus qualifying features, progressive games). It is contemplated that other pop up messages may be desirable for other icons or buttons on screen 610, such as the first toggle icon 620, or to inform the player of the function of the other icons or buttons, such as the up/down arrows or the –/+symbols for the payline selection or wager per payline selection.

Figure 7:
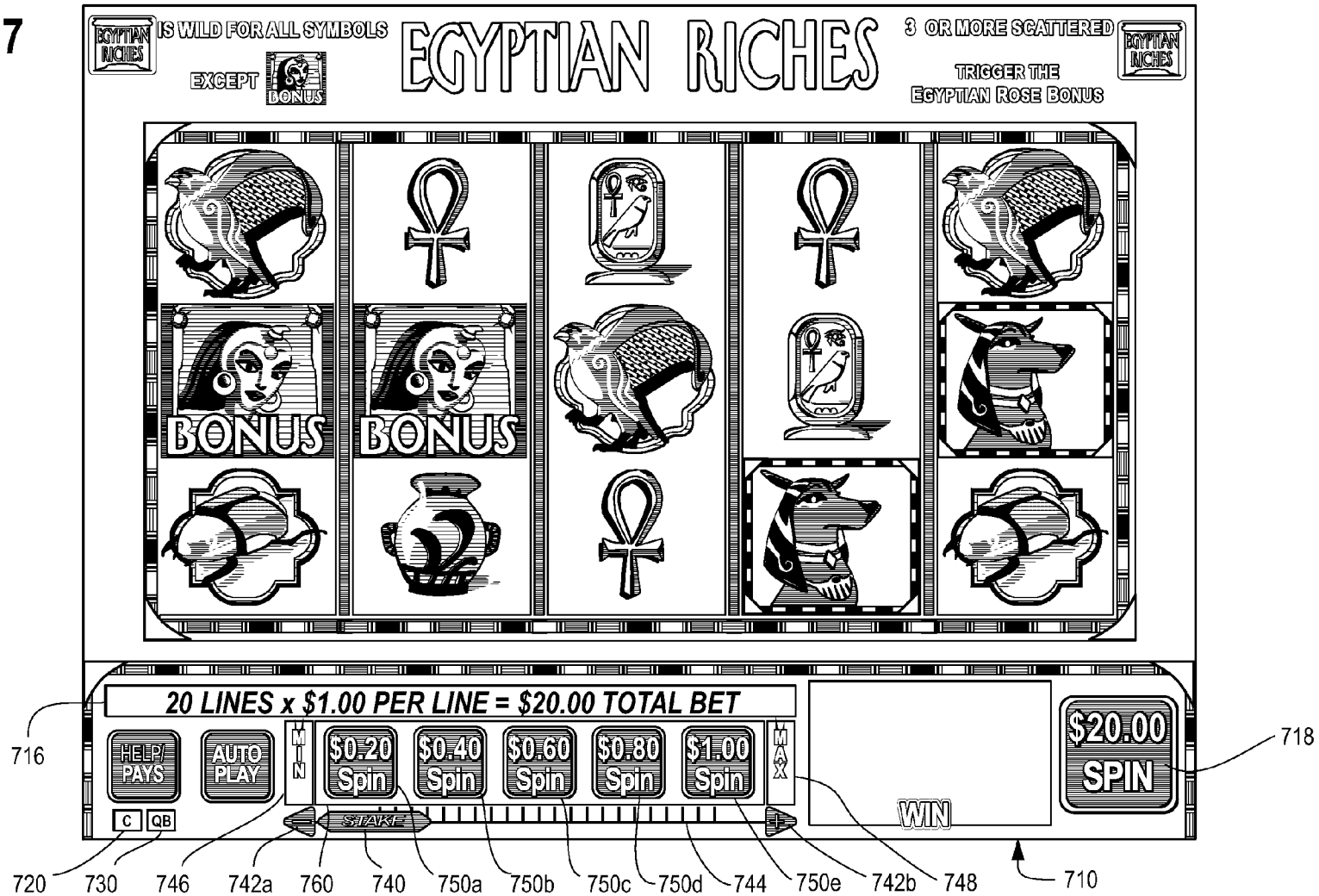
FIGS. 7-11 are images of a game screen with a wagering interface for a wagering game having a slider and multiple wager buttons that may be displayed on a gaming terminal, according to various embodiments of the present invention.

FIGS. 7-11 illustrate images on a gaming screen associated with a quick-bet wagering interface. A quick-bet wagering interface 710 on screen 700 of FIG. 7 illustrates that in addition to allowing the player to toggle back and forth between the classic wagering interface and the quick-bet wagering interface 710 via buttons 720, 730, the quick-bet wagering interface 710 can also include a quick-bet slider 740 for viewing various player-selectable quick-bet elements 750*a-e*, some visible within window 760 and some "hidden" outside the range of window 760. When a player chooses the quick-bet wagering interface, the player is provided with preconfigured total wager selections that the player can easily select. In the embodiment illustrated in FIG. 7, the player has toggled to the quick-bet wagering interface from the classic wagering interface of FIG. 5, which had total wager selection of $20.00 evenly distributed over a maximum of twenty paylines (see, for example, wager equation 716 and compare with FIG. 5). It is contemplated that in certain embodiments when toggling from the classic to the quick-bet interface, it may be desirable for the quick-bet interface 710 to show a range of quick-bet elements that correspond with the total wager that was just displayed in the classic wagering interface. For example, rather than display quick-bet elements 750*a-e* at the low end of the total wager scale (e.g., $0.20, $0.40, $0.60, $0.80, $1.00) with the selected total wager being hidden or outside of window 760, quick-bet elements can instead be displayed that are within the range of the total wager (e.g., $20.00) from the previously displayed classic wagering interface (see FIG. 5), such as $10, $12.50, $15.00, $17.50, $20.00 or $15.00, $17.50, $20.00, $25.00, $30.00. It is further contemplated that the quick-bet slider 740 may also shift to the right from where it is illustrated on the slider path 744 in FIG. 7 to correspond to the displayed range of quick-bet elements.

The player has the option of selecting the spin button 718 to proceed with the total wager of $20.00 or the player can modify his wager by selecting one of the player-selectable quick-bet elements 750*a-e*, which illustrate quick-bets at total wagers ranging from $0.20 to $1.00 for each spin of the reels. The quick-bet total wager of $0.20 illustrated in element 750*a* is based on a player betting $0.01 on the maximum number of paylines (e.g., twenty). The quick-bet total wager of $1.00 illustrated in element 750*e* is based on a player betting $0.05 per payline for the maximum number of paylines. It will be appreciated that no player-selectable quick-bet element is shown for the selected $20 total wager, which would be based on a player betting $1.00 on the maximum number of paylines (e.g., twenty). This is because the quick-bet elements are displayed in a window 760 within the quick-bet wagering interface 710 display area, which can be scrolled from left to right and vice versa using the slider 740, the left arrow (e.g., minus sign) 742*a*, the right arrow (e.g., plus sign) 742*b*, or by selecting any one of the gradations or ticks illustrated along the slider path 744 between left arrow 742*a* and left arrow 742*b*.

As the player scrolls within the window 760, additional quick-bet elements are displayed that eventually include a $20.00 quick-bet wager element. That is, window 760 and similar window embodiments are contemplated in some instances to display a subset of the total number of quick-bet element options available for selection by a player. The player can also quickly move to the quick-bet elements for the minimum and maximum total wagers by selecting the "MIN" element 746 or the "MAX" element 748. For example, by selecting MIN element 746 the slider 740 is snapped or quickly moved to the lowest total wager amount or lowest quick-bet element. By selecting MAX element 748 the slider is snapped or quickly moved to the highest total wager amount or the highest quick-bet element. It is contemplated that in certain embodiments, the selection of the MIN element 746 or the MAX element 748 may or may not adjust the wager placed and may or may not cause a spin of the reels. In certain embodiments selection of the MIN element 746 or the MAX element 748 simply adjusts the quick-bet elements being viewed in window 760. It is contemplated that a player's gaming experience can be improved by providing a pleasant viewing experience during the selection of a desired quick-bet element. For example, as the quick-bet elements move across the window 760 in response to the player moving the slider 740, the movement of the quick-bet elements can be animated to have a predetermined acceleration and/or deceleration that corresponds with how quickly or slowly the player moves the slider 740. For example, the player may move the slider quickly to a new position, but the display of the quick-bet elements in window 760 may initially accelerate and then decelerate slowly before coming to a stop based on the new position of the slider 740.

Initially, window 760 may be positioned to display the first five or lowest total wager quick-bet elements 750*a-e* starting with the minimum wager quick-bet element 750*a*. It is contemplated that window 760 can also be initialized to display quick-bet elements having a range of values that include a player's current or previously selected total wager. It is further contemplated that window 760 can be initialized to display quick-bet elements having a range of values based on the highest total wager and ending with a quick-bet element having the maximum total wager allowed by the game, e.g., $40.00.

It is contemplated that the slider path 744 can include various evenly distributed ticks or gradations having, for example, one-to-one mapping of the tick or graduation with a range of total wager amounts that will be displayed in the window 760. In certain embodiments, each tick or gradation may be mapped to a specific quick-bet element.

It is contemplated that window 760 can display more or less than five quick-bet elements or that a player can customize their experience to include as many or as few quick-bet elements within window 760. A desirable feature of the quick-bet elements is that they allow a player to quickly choose a wagering amount, and in certain embodiments, simply select a quick-bet element. The reel spin can then be immediately implemented (e.g., after a single click or selection) at the selected total wager amount, thus speeding up and simplifying game play. In other embodiments, the player can quickly select a total wager amount by selecting a quick-bet element followed by a separate selection of the spin button 718. The quick-bet wagering interface eliminates a player having to make any one of numerous readjustments that would be experienced in the classic wagering interface. Rather, with the quick-bet wagering interface, a player can quickly choose from one of several quick-bet elements that have a total wager amount based on a player playing the maximum number of paylines. It is contemplated that in certain embodiments, each quick-bet element also include in the total wager any additional wager need to participate in special features associated with the game, such as various bonus features that are triggered by a special wager or wager amount.

Figure 8:
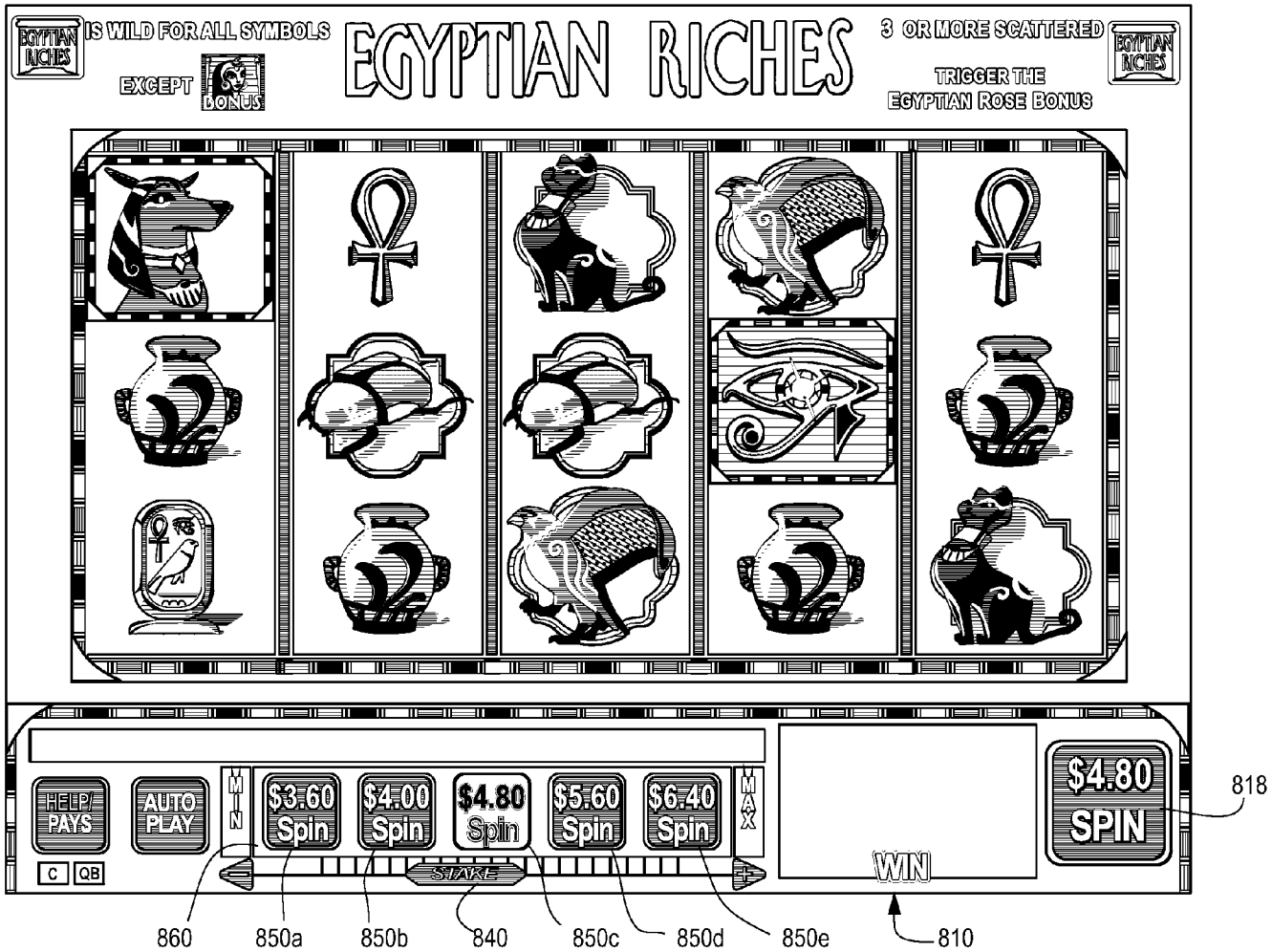

Turning now to FIG. 8, a quick-bet wagering interface 810 is illustrated having a slider 840 positioned so that a middle range of quick-bet elements 850*a-e* are displayed in window 860. In this particular example, the player has selected quick-bet element 850*c*. The selection of element 850*c* highlights the element to distinguish it from the other displayed quick-bet elements (e.g., 850*a*, 850*b*, 850*d*, 850*e*). So, for example, in the quick-bet wagering interface 710 illustrated in FIG. 7, if the player were to scroll or move the slider 760 to the right, eventually the $20.00 quick-bet would be displayed and would also be highlighted to indicate the player's current quick-bet selection. Despite the $20.00 quick-bet not being displayed in window 760, it does not lose its highlighted status until the player selects another quick-bet element. It is contemplated that in certain embodiment as a player scrolls or moves the slider, causing the displayed range of quick-bet elements to change, the highlighted or selected quick-bet may also change to be a displayed quick-bet element. For example, if a user had previously selected a total wager of $0.20 via quick-bet element 750*a*, and quick-bet element 750*a* were then highlighted similar to quick-bet element 850*c*, as the player slides slider 740 to the right quick-bet element 750*a* will exit window 760 and be "hidden" and the highlight would then automatically shift to the next quick-bet element 750*b*, which has a total wager of $0.40, and so on should the slider 740 continue to be moved to the right.

In certain embodiments, the selection of quick-bet element 850*c* places or synchronizes the associated quick-bet total wager on or with the spin button 818. In certain embodiments, the immediate selection of quick-bet element 850*c* results in the total wager displayed on the quick-bet element (e.g., $4.80) to be made and the reels to be subsequently spun without further action by the player. In other embodiments, a player's first selection of quick-bet element 850*c* sets the player's wager and a subsequent selection of either quick-bet element 850*c* or spin button 818 implements the reel spin. Furthermore, following the game outcome, the same quick-bet from the previous spin can remain highlighted, and thus, the player can simply select the quick-bet element 850*c* or the spin button 818 to trigger the next reel spin without having to again input a wager.

It is contemplated that in certain situations a user may scroll through the quick-bet elements while, for example, sliding the slider 840, thus, causing a partial display of elements positioned at the edge of the window 860, e.g., quick bet elements 850*a* or 850*e*. In certain embodiments the wagering interface can be configured or animated to move the displayed quick-bet elements in either one direction or the other in the window 860 so that the full quick-bet elements are displayed. For example, if upon sliding slider 860 a player leaves approximately the left half of quick-bet element 850*a* hidden, the wagering interface is configured to move the partially displayed element 850*a* to the right so that the entire element 850*a* is displayed in the window 860. It may also be desirable for the other displayed quick-bet elements 850*b-e* to be moved to the right along with element 850*a*.

Figure 9:
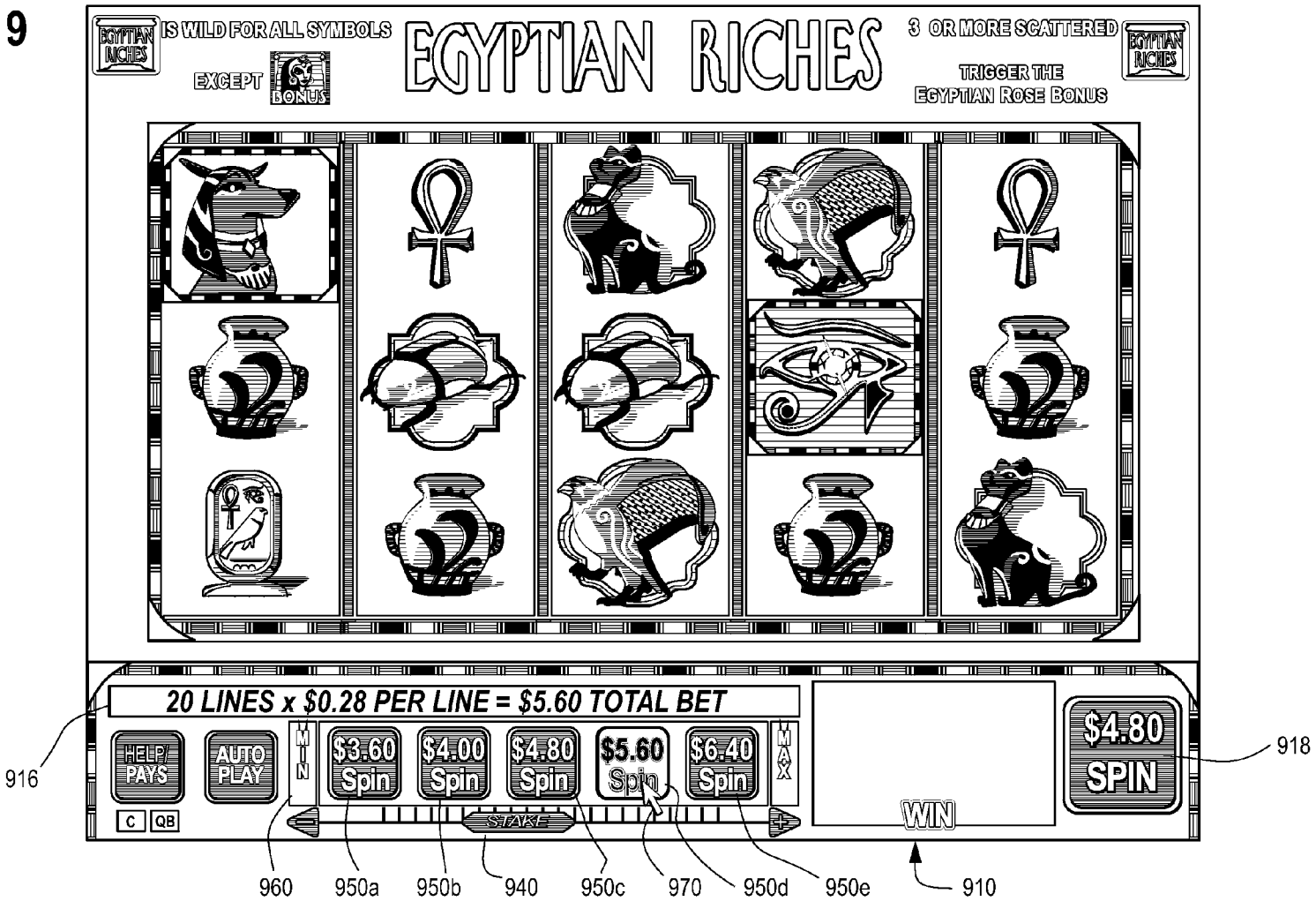

Turning now to FIG. 9, another embodiment of a quick-bet wagering interface 910 is illustrated. The wagering interface 910 includes wagering equation 916, which defines for the player the total wager for a selected quick-bet element, e.g., element 950*d* is defined as twenty paylines at $0.28 per payline or a total wager of $5.60. Display of the wager equation 916 can be particularly helpful to the player when using the quick-bet wagering interface 910 because the wager equation clarifies how the total wager was determined. FIG. 9 also illustrates a player using, for example, a mouse pointer 970 to select a quick-bet element, e.g., element 950*d*. The reels may begin to spin immediately following the selection of element 950*d*. It is also contemplated that the player may click and hold the pointer over element 950*d* such that the total wager amount selection is not complete; furthermore, the total wager amount may not synchronize with the wager amount displayed in spin button 918 until the selected amount wagered is fully determined. In certain embodiments, simply moving the pointer 970 over or hovering over a quick-bet element, such as element 950*d*, can highlight the element along with displaying the associated wager equation 916. The total wager can then be determined upon the player affirmatively selecting one of the quick-bet elements.

Figure 10:
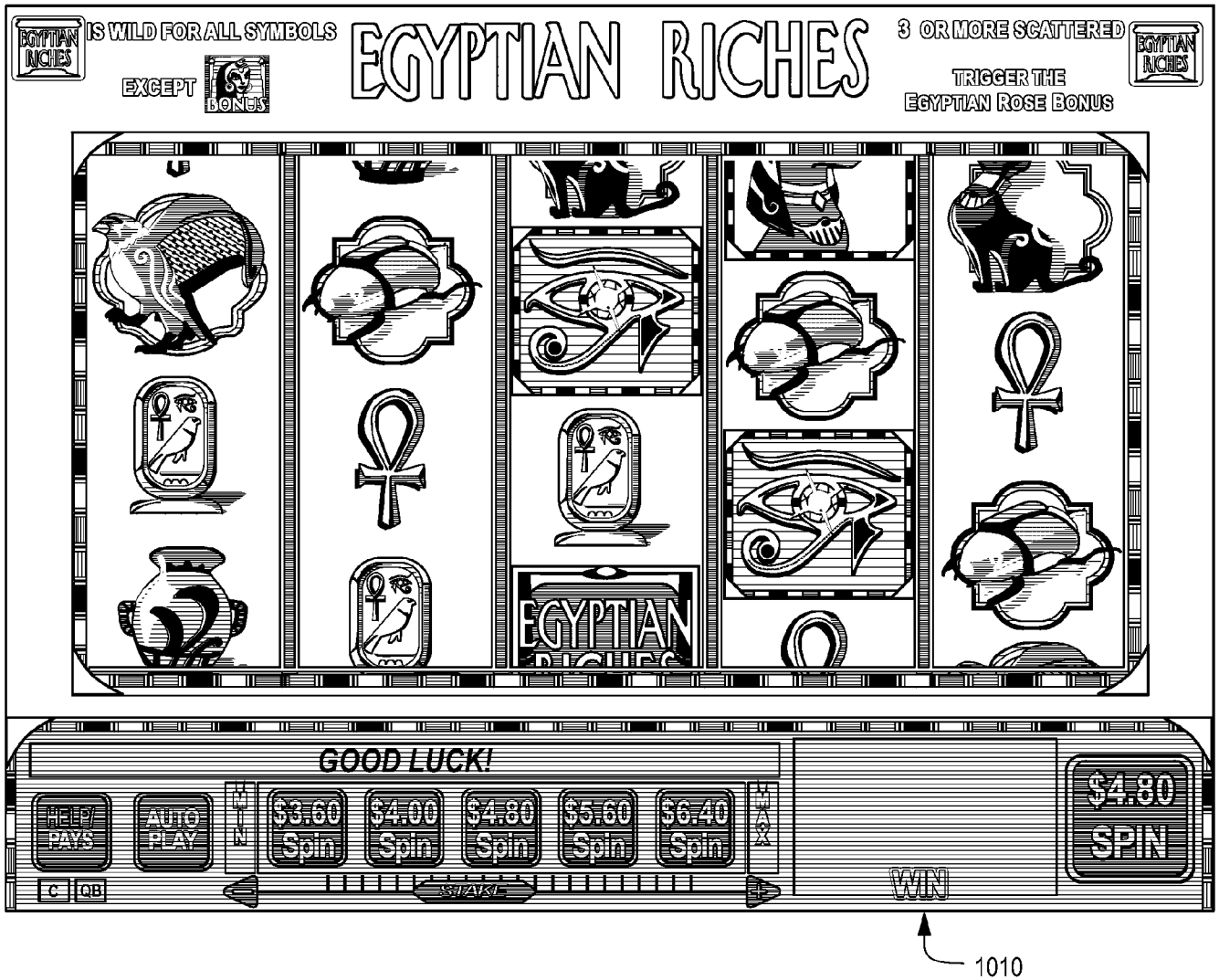

Turning now to FIG. 10, an embodiment of the quick-bet wagering interface is illustrated with the reels spinning following the selection of a quick-bet. To enhance the player's viewing experience, the quick-bet wagering interface 1010 may darken or turn gray to deemphasize the wagering interface 1010 and simultaneous draw the player's attention to the spinning reels. In certain embodiments, the deemphasizing of the wagering interface 1010 may not occur until the spinning reels are coming to a stop.

Figure 11:
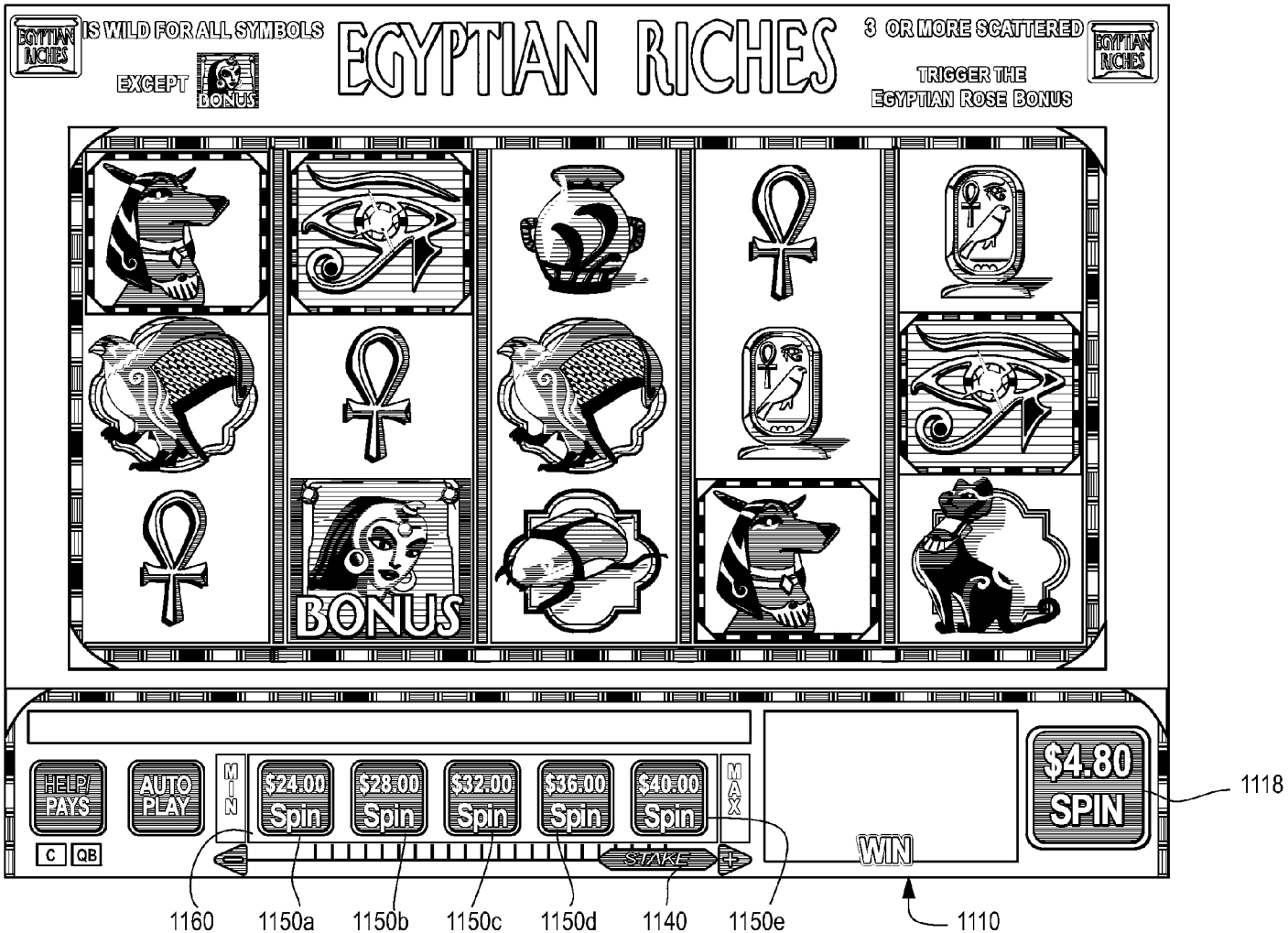

Turning now to FIG. 11, an embodiment of a quick-bet wagering interface 1110 is illustrated with the slider 1140 placed at the maximum wager level, e.g., at quick-bet element 1150*e*. That is, the slider 1140 is illustrated as having been moved all the way to the right, or to an extreme position, on the slider path with quick-bet elements 1150*a-e* displayed in window 1160. The total wager can remain at a lower total wager amount, e.g., at $4.80 as illustrated by spin button 1118, while the player moves through the quick-bet elements to determine what wager to make on the next spin. The highlighted quick-bet element for $4.80 is not shown in window 1160 because this quick-bet element remains hidden or outside the view of window 1160 to the left of quick-bet element 1150*a*.

It is contemplated that in certain embodiments special provisions may be desirable for the quick-bet wagering interface, such as in the situation where a player starts to run low on credits and can no longer sustain certain total wager amounts. For example, it is contemplated that any quick-bet element having a total wager amount greater than the credit or funds the player has available will be grayed out or disabled so the element is no longer selectable by the player. In other embodiments, a new maximum wager will be established that is equal to or less than the players remaining credits. The new maximum wager amount can then be displayed on several quick-bet elements. For example, if a player only has $24.00 remaining, each of elements 1150*b-e* will be changed to look like quick-bet element 1150*a*.

The slider described in FIGS. 7-9 and 11 is illustrated having left and right movement or sliding. It is contemplated that the slider can also be disposed on the quick-bet wagering interface as an up-down slider or otherwise. It is also contemplated that the distribution of total wagers for the quick-bet elements may or may not be linear. For example, as the total wager increases, it may be desirable to have higher increases in the total wager increment between quick-bet elements in a similar range. Thus, a non-linear distribution of total wager values for the quick-bet elements may be used top provide a player, for example, many total wager options at lower total wagers and fewer total wager options as you approach to desired maximum total wager. Thus, there may be more quick-bet elements associated with lower total wager amounts than with higher total wager amounts.

It is contemplated that in certain embodiments, the payout percentages may vary for a machine depending on the total wager amount or range of total wager amounts that a player selects. For example, for quick-bet elements at lower total wager amounts the payout percentage of the game may be set to, for example, 88 percent. However, as the player moves to or slides to quick-bet elements having higher total wager amounts, the payout percentage may be increased to, for example, 91 percent. In certain embodiments, the slider or the slider path can include color animation or color gradations to identify by color the "hot" zones (e.g., higher payout percentage) or "cold" zones (e.g., lower payer percentage). The "hot" or "cold" zone features can also be applied to other elements such as the quick-bet elements, the slider path, etc.

It is contemplated that in the embodiments illustrated in FIGS. 7-11 the quick-bet elements are animated as they move or slide through the window, e.g., 760, 860, 960, 1160, including animating the movement for any highlighted quick-bet elements, e.g., 850*c*, 950*d*.

It is contemplated that in certain embodiments it may be desirable to customize and save a player's wagering interface and/or the player's wagering preferences. For example, following the login of a player to a gaming session or authentication using a card-based or account-based gaming system, the gaming session may immediately default or automatically display a classic wagering interface or a quick-bet wagering interface, depending on the player's historical preferences. Similarly, the gaming system may track a player's historical wagering preferences and immediately default to display certain ranges of quick-bet elements. For example, a player may prefer to bet $1.00 per spin—so the quick-bet wagering interface can automatically display a window of quick-bet elements with the $1.00 quick-bet element in the middle of the window. In certain embodiments, the wagering interface or wagering preference will be assigned to the wager interface or wager preference used by the player in his last gaming session.

It is contemplated that it may be desirable to allow a player to customize the quick-bet elements displayed in the window to include the players maximum wager amount, minimum wager amount, and their standard preferred wager amount. It is further contemplated that certain quick-bet elements can be frozen or fixed in the window while the player scrolls through the remaining quick-bet elements, resulting in a split window arrangement. For example, a player may freeze the quick-bet element associated with their preferred maximum bet and then freely scroll through the remaining quick-bet elements being animated as they move through the window.

It is contemplated that the quick-bet wagering interface described herein may be desirable for online gaming or for gaming sessions on portable devices, such as PDAs or mobile devices. However, the embodiments described herein can also be applied to terminals primarily dedicated to video-based slot games. Furthermore, the embodiments described herein can modified in different ways. For example, rather than using a pointer, a touchscreen LCD display or similar device can be used to accept player inputs and to allow a player to select a quick-bet element. It is also contemplated that a gaming device may have a secondary touchscreen that operates as the quick-bet wagering interface.

It is contemplated that in certain embodiments a gaming system has a controller operative to present a wagering interface on a display. The wagering interface is associated with a wagering game having a plurality of symbol-bearing reels. The wagering interface includes a plurality of player-selectable quick-bet elements. Each quick-bet element indicates a different total wager for a spin of the plurality of reels. Each total wager is at least partially divided among a plurality of paylines associated with positions on one or more of the reels. A window is configured to display a subset of the plurality of quick-bet elements. A quick-bet element selection slider is configured to allow each of the plurality of player-selectable quick-bet elements to be displayed within the window. The selection slider is movable to a plurality of positions along a slider path such that the position of the selection slider on the slider path determines the subset of quick-bet elements to be displayed in the window.

It is further contemplated that in certain embodiments the gaming system may be configured where a randomly selected outcome of the wagering game and the wagering interface are displayed in a plurality of display areas on a single display. A plurality of player-selectable quick-bet elements may also be configured to be portrayed as player-selectable buttons. The wagering interface may include one or more toggling elements for switching from the wagering interface having the plurality of player-selectable quick-bet elements to a classic-bet wagering interface. The wagering interface may include a pointer configured for moving the selection slider and for selecting a quick-bet element displayed in the window. The wagering interface may further include a pointer element where the positioning of the pointer element over the user toggling element causes information associated with the toggling element to be displayed. The total wager may also include a wager that triggers a special feature associated with a bonus game. A player's selection of one of the displayed quick-bet elements may also cause a wager to be placed in the wagering game and the plurality of reels to spin.

It is contemplated that in certain embodiments a method for conducting wagering on a slots game has a plurality of symbol-bearing reels. The game is implemented on one or more processors associated with a gaming system and includes receiving a wager via a network connection associated with the one or more processors. The wager is associated with a wagering interface that includes a plurality of player-selectable quick-bet elements with each quick-bet element configured to indicate a different total wager for a spin of the plurality of reels and each total wager being at least partially divided among a plurality of paylines. The wager interface also includes a window with at least a portion of the quick-bet elements being initially displayed in the window and at least a portion of the quick-bet elements not being initially displayed in the window. A quick-bet selection slider is movable to a plurality of positions along a slider path such that the position of the selection slider on the slider path determines the portion of the quick-bet elements to be displayed in the window. The method further includes receiving an input via a network connection associated with the one or more processors. The input is associated with a position of the selection slider along the slider path of the wagering interface. In response to the received input, the portion of quick-bet elements to be displayed in the window is reconfigured.

It is further contemplated that in certain embodiments the method includes each quick-bet element configured to implement a simulated spinning of the plurality of reels following the receiving of the wager. Each of the displayed plurality of player-selectable quick-bet elements may be configured to be portrayed as a player-selectable button. The wagering interface may also includes one or more user toggling elements, and may further include receiving an input via a network connection associated with the one or more processors with the input associated with switching from the wagering interface having the plurality of player-selectable quick-bet elements to a classic-bet wagering interface. The wagering interface may also include a pointer element that allows movement of the selection slider and selection of a displayed quick-bet element. The wagering interface may also include a pointer element, and movement of the pointer element over the user toggling element may initiate a display of information associated with the user toggling element.

It is contemplated that in certain embodiments one or more computer readable storage media are encoded with instructions, which when executed by at least one processor associated with a gaming system, causes the at least one processor to accomplish steps including receiving a wager via a network connection associated with the at least one processor. The wager is associated with a wagering interface including a plurality of player-selectable quick-bet elements. Each quick-bet element is configured to indicate a different total wager for a spin of the plurality of reels and each total wager is at least partially divided among a plurality of paylines. The wager interface further includes a window where at least a portion of the quick-bet elements are initially displayed in the window and at least a portion of the quick-bet elements are not initially displayed in the window. The wager interface further includes a quick-bet selection slider movable to a plurality of positions along a slider path such that the position of the selection slider on the slider path determines the portion of quick-bet elements to be displayed in the window. The step further include receiving a first input via a network connection associated with the at least one processor. The first input is associated with a position of the selection slider along the slider path of the wagering interface. In response to the received first input, the portion of quick-bet elements to be displayed in the window is reconfigured.

It is further contemplated that in certain embodiments one or more computer readable storage media are encoded with instructions where each of the plurality of player-selectable quick-bet elements are configured to be portrayed as a player-selectable button. The steps may also include receiving a second input via a network connection associated with the at least one processor. The second input is associated with one or more toggling elements for switching the wagering interface from having the plurality of player-selectable quick-bet elements to a classic-bet wagering interface. The total wager may include a wager that triggers a special feature associated with a bonus game. The quick-bet elements that are initially displayed may be determined from historical wagering game activity received over a network.

It is contemplated that in certain embodiments a gaming system has a controller operative to present a plurality of wagering interfaces on a display. The plurality of wagering interfaces are associated with a wagering game having a plurality of symbol-bearing reels. The plurality of wagering interfaces include a first wagering interface associated with a display and a second wagering interface associated with the display. At least one quick-toggle element is located on each of the first and second wagering interfaces and configured for switching between the first wagering interface and the second wagering interface by user selection of the at least one quick-toggle element.

It is further contemplated that in certain embodiments the first wagering interface of the gaming system is a quick-bet wagering interface. The quick-bet wagering interface has a plurality of player-selectable quick-bet elements with each quick-bet element indicating a different total wager for a spin of the plurality of reels. Each total wager is at least partially divided among a plurality of paylines associated with positions on one or more of the reels. At least a portion of the quick-bet elements may be initially displayed in a window and at least a portion of the quick-bet elements may not be initially displayed in the window. The second wagering interface may be a classic wagering interface. A pointer element may cause information associated with the quick-toggle element to be displayed where the pointer element is positioned over the at least one quick-toggle element.

Each of these embodiments and obvious variations thereof is contemplated as falling within the spirit and scope of the claimed invention, which is set forth in the following claims.

What is claimed is:

1. A gaming system having a controller operative to present a wagering interface on a display, the wagering interface associated with a wagering game having a plurality of symbol-bearing reels, the wagering interface comprising:

a plurality of player-selectable quick-bet elements, each quick-bet element indicating a different total wager for a spin of the plurality of reels, each total wager being at least partially divided among a plurality of paylines associated with positions on one or more of the plurality of symbol-bearing reels;

a window configured to display a subset of the plurality of quick-bet elements such that a first plurality of the plurality of player-selectable quick bet elements are initially displayed in the window and a second plurality of the plurality of player-selectable quick-bet elements are not initially displayed in the window, thereby allowing a player to select one of the first plurality of displayed quick bet elements, the first plurality of displayed quick-bet elements simultaneously displaying their respective total wagers; and a quick-bet element selection slider configured to allow each of the plurality of player-selectable quick-bet elements to be displayed within the window, the selection slider movable to a plurality of positions along a slider path such that the position of the selection slider on the slider path determines the subset of quick-bet elements to be displayed in the window.

2. The gaming system of claim 1, wherein a randomly selected outcome of the wagering game and the wagering interface are configured to be displayed in a plurality of display areas on a single display.

3. The gaming system of claim 1, wherein the plurality of player-selectable quick-bet elements are configured to be portrayed as player-selectable buttons.

4. The gaming system of claim 1, wherein the wagering interface includes one or more toggling elements for switching from the wagering interface having the plurality of player-selectable quick-bet elements to a classic-bet wagering interface.

5. The gaming system of claim 1, wherein the wagering interface includes a pointer configured for moving the selection slider and for selecting a quick-bet element displayed in the window.

6. The gaming system of claim 4, wherein the wagering interface includes a pointer element, the positioning of the pointer element over the user toggling element causing information associated with the toggling element to be displayed.

7. The gaming system of claim 1, wherein the total wager includes a wager that triggers a special feature associated with a bonus game.

8. The gaming system of claim 1, wherein a player's selection of one of the displayed quick-bet elements causes a wager to be placed in the wagering game and the plurality of reels to spin.

9. A method for conducting a wagering game having a plurality of symbol-bearing reels, the wagering game implemented on one or more processors associated with a gaming system, the method comprising the act of:

receiving a wager via a network connection associated with the one or more processors, the wager associated with a wagering interface, the wagering interface including:

(a) a plurality of player-selectable quick-bet elements, each quick-bet element configured to indicate a different total wager for a spin of the plurality of reels and each total wager being at least partially divided among a plurality of paylines, (b) a window, a first plurality of the plurality of player-selectable quick bet elements being initially displayed in the window and a second plurality of the plurality of player-selectable quick-bet elements not being initially displayed in the window thereby allowing a player to select one of the first plurality of displayed quick bet elements, the first plurality of displayed quick-bet elements simultaneously displaying their respective total wagers, and (c) a quick-bet selection slider movable to a plurality of positions along a slider path such that the position of the selection slider on the slider path determines the portion of the quick-bet elements to be displayed in the window;

receiving an input via a network connection associated with the one or more processors, the input associated with a position of the selection slider along the slider path of the wagering interface; and in response to the received input, reconfiguring the plurality of player-selectable quick-bet elements to be displayed in the window.

10. The method of claim 9, wherein each quick-bet element is configured to implement a simulated spinning of the plurality of reels following the receiving of the wager.

11. The method of claim 9, wherein each of the displayed plurality of player-selectable quick-bet elements are configured to be portrayed as a player-selectable button.

12. The method of claim 9, wherein the wagering interface includes one or more user toggling elements, and further comprising receiving an input via a network connection associated with the one or more processors, the input associated with switching from the wagering interface having the plurality of player-selectable quick-bet elements to a classic-bet wagering interface.

13. The method of claim 10, wherein the wagering interface includes a pointer element, the pointer element allowing movement of the selection slider and selection of a displayed quick-bet element.

14. The method of claim 12, wherein the wagering interface includes a pointer element, and movement of the pointer element over the user toggling element initiates a display of information associated with the user toggling element.

15. The method of claim 12, wherein the quick-bet elements to be initially displayed are determined from historical wagering game activity received over a network.

16. A gaming system having a controller operative to present a plurality of wagering interfaces on a display, the plurality of wagering interfaces associated with a slots wagering game having a plurality of symbol-bearing reels, the plurality of wagering interfaces comprising:

a quick-bet wagering interface associated with a display, the quick-bet wagering interface including a plurality of player-selectable quick-bet elements, each quick-bet element indicating a different total wager for a spin of the plurality of reels, each total wager being at least partially divided among a plurality of paylines associated with positions on one or more of the plurality of symbol-bearing reels;

a second wagering interface associated with the display, the second wagering interface including a payline adjuster configured to allow player selection of a number of paylines for each play of the slots wagering game and a bet-per-line adjuster configured to allow player selection of a wager amount for each of the number of paylines;

at least one quick-toggle element located on each of the quick-bet and second wagering interfaces and configured for switching between the quick-bet wagering interface and the second wagering interface by user selection of the at least one quick-toggle element.

17. The gaming system of claim 16, wherein at least a portion of the quick-bet elements are initially displayed in a window and at least a portion of the quick-bet elements are not initially displayed in the window.

18. The gaming system of claim 16, further comprising a pointer element, wherein positioning the pointer element over the at least one quick-toggle element causes information associated with the quick-toggle element to be displayed.

19. The gaming system of claim 16, wherein the payline adjuster includes an up arrow and a down arrow.

20. The gaming system of claim 16, wherein the bet-per-line adjuster includes an up arrow and a down arrow.

* * * * *